US008429763B2

(12) United States Patent
Hawbaker

(10) Patent No.: US 8,429,763 B2
(45) Date of Patent: Apr. 30, 2013

(54) COMPRESSIBLE AND STORABLE ITEMS OF APPAREL

(76) Inventor: Veronica Hawbaker, Nashville, TN (US)

( * ) Notice: Subject to any disclaimer, the term of this patent is extended or adjusted under 35 U.S.C. 154(b) by 501 days.

(21) Appl. No.: 12/685,811

(22) Filed: Jan. 12, 2010

(65) Prior Publication Data

US 2010/0177992 A1 Jul. 15, 2010

Related U.S. Application Data

(60) Provisional application No. 61/144,531, filed on Jan. 14, 2009.

(51) Int. Cl.
*A41D 3/02* (2006.01)

(52) U.S. Cl.
USPC ..... 2/86

(58) Field of Classification Search ..... 2/93, 94, 2/102, 108, 71, 72, 69.5, 86
See application file for complete search history.

(56) References Cited

U.S. PATENT DOCUMENTS 2,058,474 A * 10/1936 Long ..... 2/85
4,347,629 A 9/1982 Itoi
4,476,587 A * 10/1984 Itoi ..... 2/94
4,944,042 A * 7/1990 DeWan ..... 2/94
5,123,117 A * 6/1992 Prendergast ..... 2/108
D378,244 S 3/1997 Cassida
5,787,504 A * 8/1998 Wu ..... 2/93
8,032,948 B2 * 10/2011 Anderson ..... 2/69
2007/0194072 A1 8/2007 Irwin Guzinski

FOREIGN PATENT DOCUMENTS

JP 10-295424 A 11/1998
JP 2008-284084 A 11/2008

OTHER PUBLICATIONS

International Search Report and Written Opinion of the ISA for PCT/US2010/020743, (Jan. 12, 2010).

* cited by examiner

*Primary Examiner* — Tejash Patel
(74) *Attorney, Agent, or Firm* — PatentBest; Andrew McAleavey

(57) ABSTRACT

Compressible and storable items of apparel are disclosed. In one embodiment, an item of apparel has a generally circular channel substantially centered on a panel. A flexible, elongate member or drawstring extends through the channel and protrudes from an opening in it. The item of apparel can be compressed by folding toward the area defined by the channel and pulling the drawstring, causing the area defined by the channel to be drawn up and around the folded item of apparel, thereby compressing and encapsulating it. The item of apparel may be, for example, a sweatshirt or jacket, in which case the generally circular channel may be disposed on a rear panel of the torso portion.

11 Claims, 12 Drawing Sheets

COMPRESSIBLE AND STORABLE ITEMS OF APPAREL

CROSS-REFERENCE TO RELATED APPLICATIONS

This application claims priority to U.S. Provisional Application No. 61/144,531, filed Jan. 14, 2009, the contents of which are incorporated by reference herein in their entirety.

BACKGROUND OF THE INVENTION

1. Field of the Invention

The invention relates to bags and other items that are compressible and storable.

2. Description of Related Art

Bags of one sort or another are ubiquitous in most cultures. At some point, nearly everyone needs to carry something, protect an item, or carry several things together, and a wide variety of bags have evolved to meet those different needs. Available bags range from utilitarian paper and plastic grocery sacks costing a few cents each to designer purses and satchels costing many hundreds of dollars each.

Most bags present a conundrum: the larger the bag, the more objects it can hold and the more potentially useful it may be; however, large bags can be cumbersome to carry around, and most people need a large bag for only a short time, for example, after a shopping trip. The typical solution to this conundrum is to fold or stuff a larger bag into a smaller bag until it is needed. Unfortunately, many large bags take up a considerable amount of space even when folded. Additionally, a large bag may become wrinkled from storage in a smaller bag. Wrinkling may be acceptable when the bags are utilitarian grocery sacks, but is generally unacceptable with more valuable bags, which are hard to unwrinkle and may be permanently damaged.

Similar problems often occur with other carry-along items, such as blankets, towels, sweatshirts, and other types of apparel. These items are sometimes needed only for short periods of time, yet often need to be carried on an entire outing so that they are available when needed. Some apparel items, such as light jackets, are sold with "stuff sacks" or other forms of storage container that make it easier to carry them when not in use, but those storage containers become yet another item that must be carried and can easily be lost or forgotten.

SUMMARY OF THE INVENTION

One aspect of the invention relates to a compressible bag. The bag includes a sidewall having a generally circular channel that defines an area. A flexible, elongate member or drawstring extends around the circumference of the channel and protrudes from an opening therein. The channel and bag are constructed and arranged such that if the bag is folded toward the area defined by the channel and the drawstring is drawn, the area defined by the channel will be drawn up around the rest of the bag, compressing and encapsulating it.

Another aspect of the invention relates to a bag having a channel with a drawstring that extends across one or more sidewalls of the bag. For example, the channel may extend circumferentially around the bag. When the bag is folded into a volume of space defined between the bottom of the bag and the drawstring and the drawstring is drawn, the bag is compressed.

A further aspect of the invention relates to compressible blankets, towels, fabric panels, apparel, and other items. The blankets, fabric panels, and other items have a generally circular channel that defines an area. A flexible, elongate member or drawstring extends around the circumference of the channel and protrudes from an opening therein. The channel and blanket or fabric panel are constructed and arranged such that if the blanket or panel is folded toward the area defined by the channel and the drawstring is drawn, the area defined by the channel will be drawn up around the rest of the blanket or panel, compressing and encapsulating it.

In particularly advantageous embodiments of the invention, compressible bags and other items are made of low-friction materials, such as satins. Alternatively, items may be lined or selectively with these materials. In some embodiments, the flexible elongate member may be a flat satin ribbon.

Yet another aspect of the invention relates to a garment. The garment has one or more pieces of fabric joined together to define a covering for an upper portion of a human body. The covering has a torso portion, two arm portions connected to the torso portion, and a head opening. A generally circular channel is provided in the torso portion. The generally circular channel defines an area on the torso portion and has an exterior channel opening and a size defined in proportion to the dimensions of the garment. A flexible, elongate member is positioned within the generally circular channel and extends through substantially the entirety of the circumference of the channel such that at least an exposed portion of the elongate member protrudes from the opening of the channel. The channel is proportioned and arranged such that if the garment is folded inwardly toward the area defined by the channel with the channel facing outwardly and the exposed portion of the flexible, elongate member is pulled, the area defined by the channel is drawn out of plane as the channel contracts, causing the garment to be releasably compressed within an enclosure having the area defined by the generally circular channel as an outer surface.

Other aspects, features, and advantages of the invention will be set forth in the description that follows.

BRIEF DESCRIPTION OF THE DRAWINGS

The invention will be described with respect to the following drawing figures, in which like numerals represent like elements throughout the figures, and in which.

DETAILED DESCRIPTION

Figure 1:
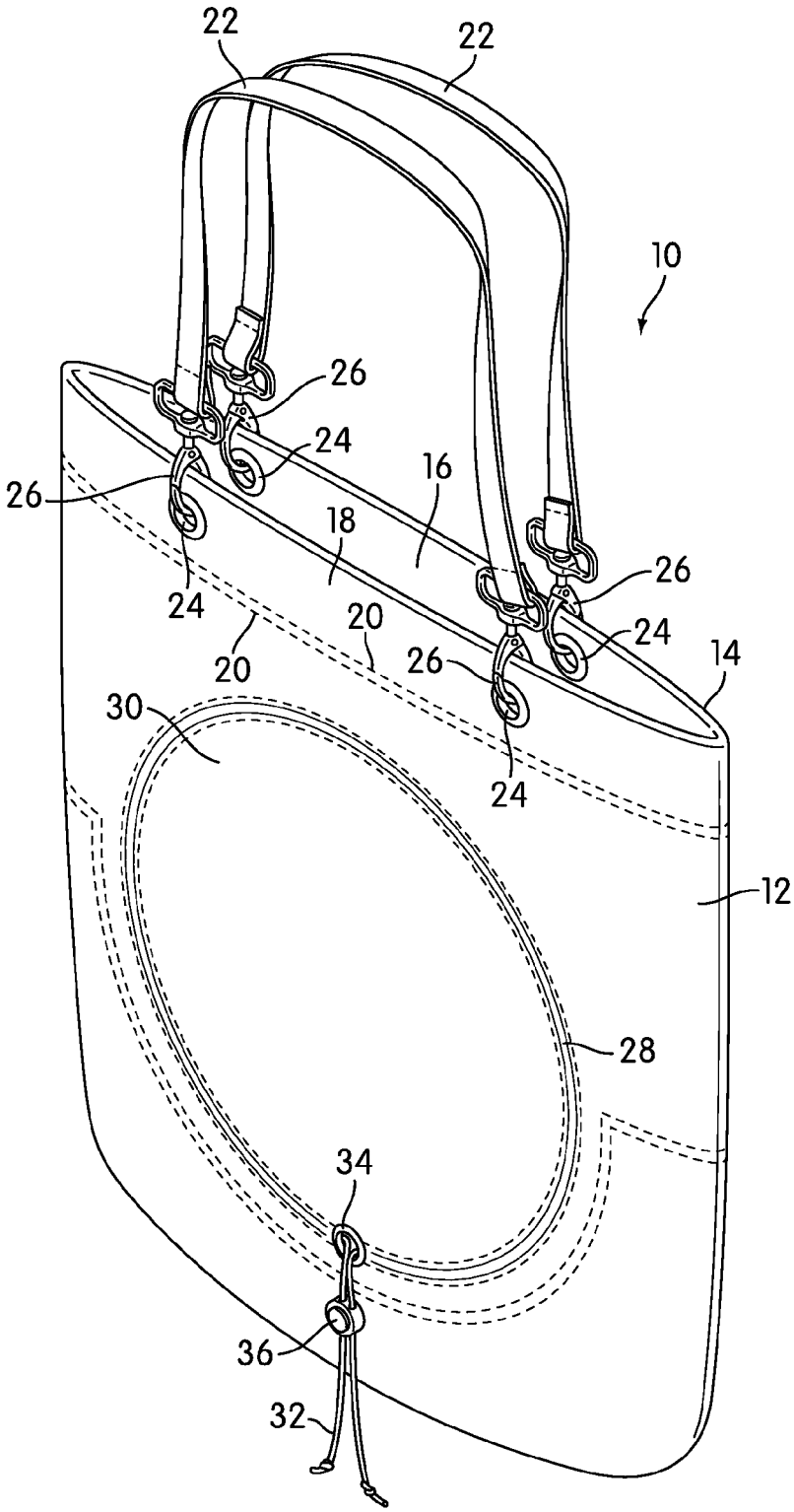
FIG. 1 is a perspective view of a bag according to one embodiment of the present invention.
Figure 2:
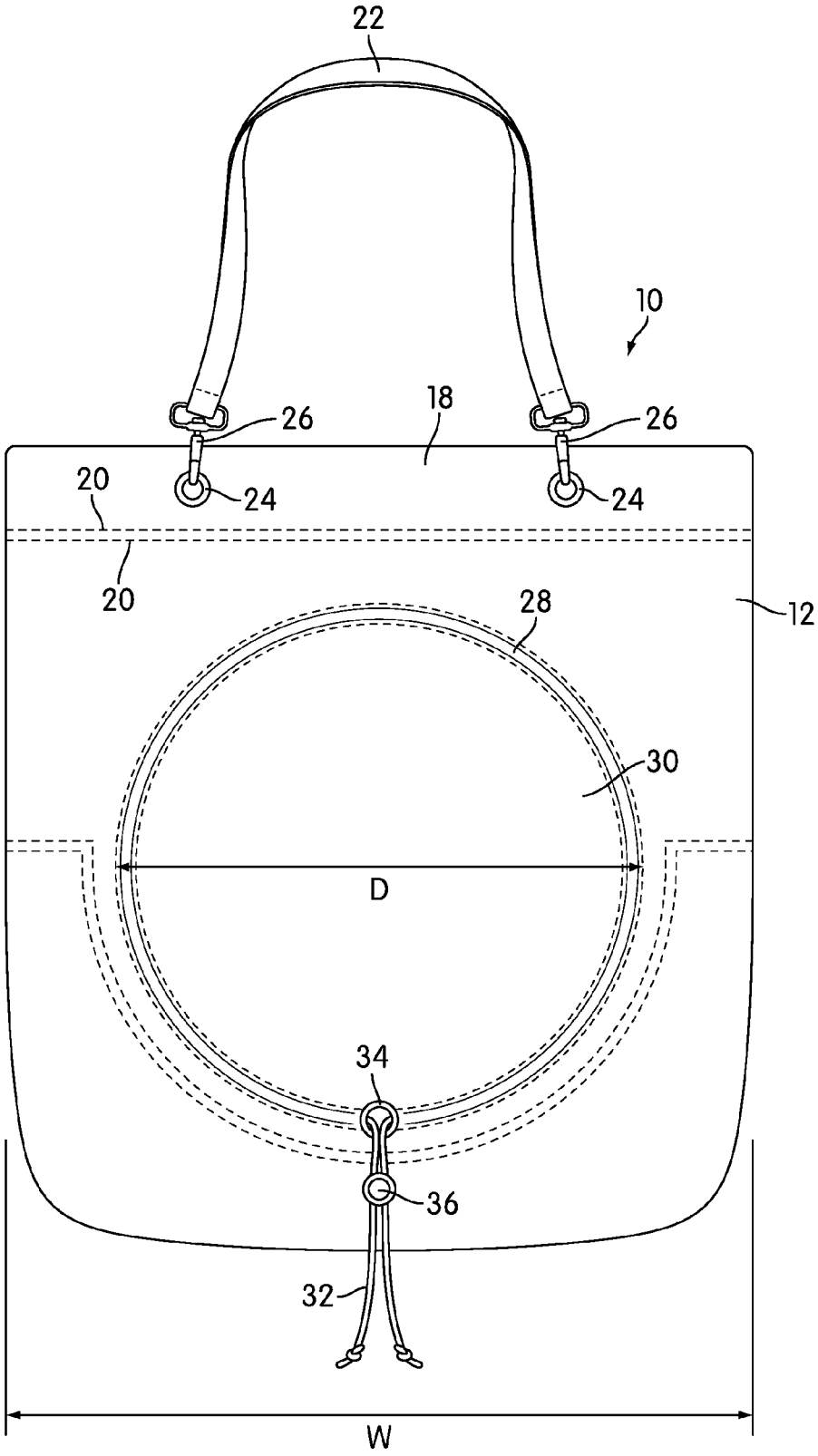
FIG. 2 is a front view of the bag of FIG. 1.

FIG. 1 is a perspective view of a bag, generally indicated at 10, according to one embodiment of the invention, and FIG. 2 is a front view of the bag 10. The bag 10 of the illustrated embodiment has first and second sidewalls 12, 14 that are joined together along three edges to define a storage volume with an opening 16 at the top. The two sidewalls 12, 14 may be joined together directly or indirectly. For example, along the bottom edge of the bag 10, gusset material may provided between the two sidewalls 12, 14, creating a bottom that can expand, for example, about 5-6 inches. In other embodiments, the bag may have gusset material between the sidewalls 12, 14 at their left and right edges, or the bag may have four distinct sidewalls.

At the top edge 18 of the bag 10, proximate to the opening 16, the edges of the sidewalls 12, 14 may be hemmed or otherwise finished, as shown in FIG. 1. The stitch lines 20 used for the hemming may or may not serve as decorative or ornamental elements, depending on the embodiment. Additionally, a handle 22 is attached to each sidewall 12, 14 near the opening. The handles 22 may be of any type or style, and they may be attached by any method, including sewing and adhesive bonding. As shown, openings with grommets 24 are provided in the top edge 18, and the handles 22 terminate in clips 26 that are releasably secured within the grommeted openings 24. However, as those of skill in the art will realize, FIG. 1 illustrates only one way in which handles may attach to the bag 10. In other embodiments, handles may attach to the bag in different positions, and there may be one handle or several handles.

Preferably, the sidewalls 12, 14 and other elements of the bag 10 are made of a flexible material, such as fabric, although sheets of plastic and other materials may be used in some embodiments. Each sidewall 12, 14 may be comprised of multiple layers of material; for example, each sidewall 12, 14 may include an inner lining layer of material that is sewn, bonded, or otherwise connected to an outer layer made of the same or a different material. Particular considerations in materials selection will be described in more detail below.

As shown in FIGS. 1-2, one of the sidewalls 12 includes a generally circular channel 28 that defines and encloses a generally circular area 30 of the sidewall 12. The channel 28 may be defined in the sidewall 12 by stitching together the inner and outer layers of sidewall material, if the sidewall 12 is comprised of two or more layers of material, or it may be defined by sewing, bonding, or otherwise securing an annulus of fabric or other flexible material to the exterior of the sidewall 12. A flexible, elongate member or drawstring 32 is positioned within the channel 28 and extends around substantially the entirety of the channel 28 such that at least a portion of it protrudes from an exterior opening 34 in the channel 28. As shown in FIG. 1, the ends of the drawstring 32 extend from the opening 34 and pass through a cinching device 36. The drawstring 32 should generally be of a thickness and material that allow it to slide relatively easily within the channel 28, as will be described below in more detail.

Figure 4:
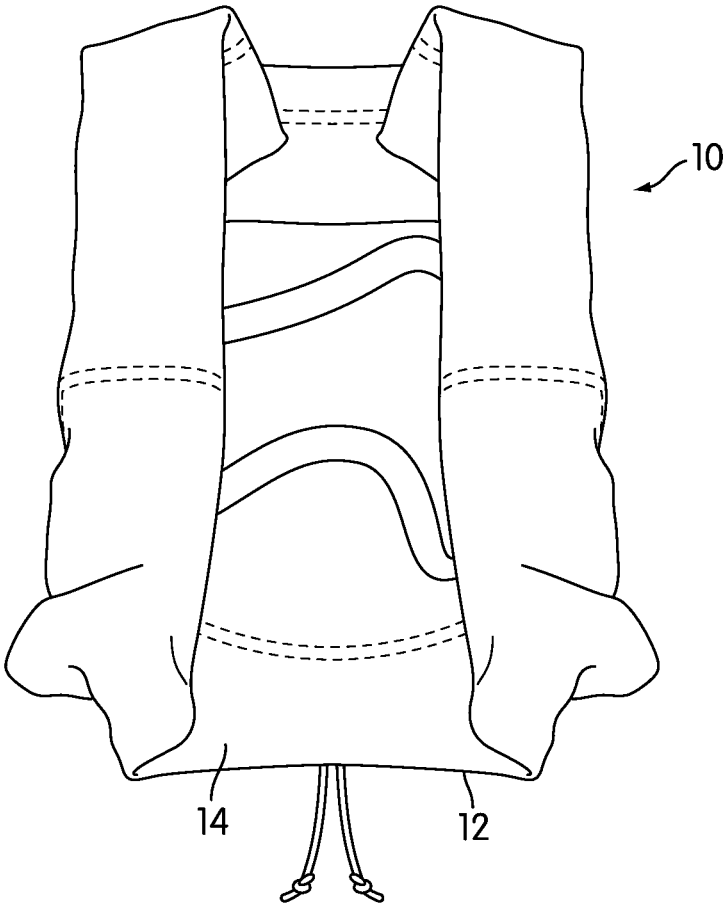
FIGS. 4-6 are perspective views illustrating the process of collapsing the bag of FIG. 1.
Figure 5:
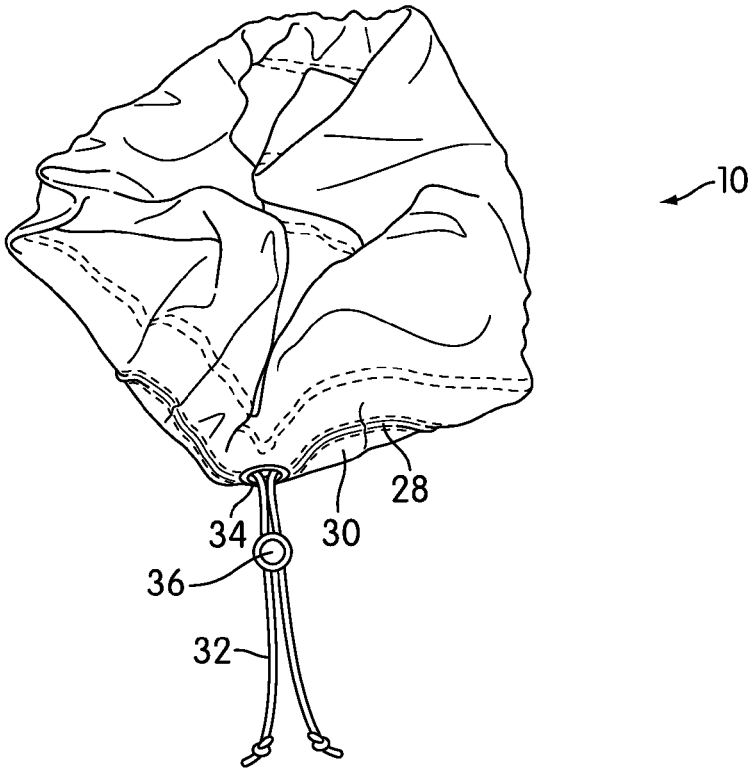
Figure 6:
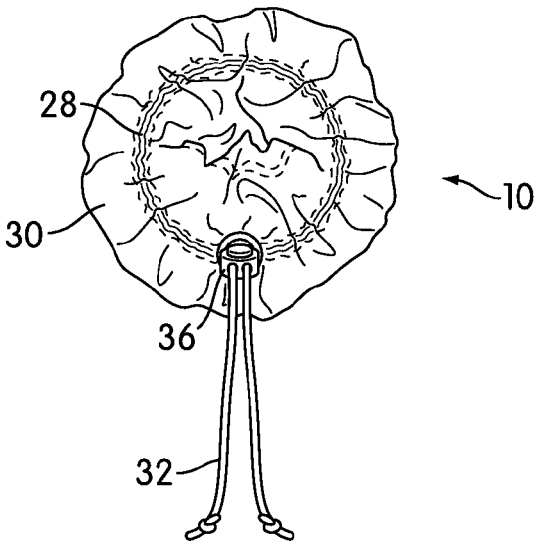

The channel 28 in the sidewall 12 of the bag 10 allows the bag to be compressed into a smaller volume of space for storage. This process is illustrated in FIGS. 4-6, which are perspective views of the bag 10. As shown in FIG. 4, the first step in compressing the bag is to place the bag channel-side down (or alternatively, channel side out) and fold portions of the bag inwardly, toward the central area 30 defined by the channel 28. Once all of the material of the bag 10 is folded in with the channel 28 facing out, as shown in FIG. 5, the user then pulls the drawstring 32. As the drawstring 32 is pulled out of the opening 34, the channel 28 contracts and the material of the defined area 30 is drawn out-of-plane and up around the rest of the folded bag 10, encapsulating and compressing it with defined area 30 of the sidewall 12 acting as the outer surface of the bag 10 in its compressed state. To maintain the compressed configuration shown in FIG. 6, the user slides the cinching device 36 along the drawstring 32 until it bears against the opening 34. The bag 10 can be returned to the configuration of FIGS. 1-2 by pulling the cinching device 36 away from the opening 34, opening the channel 28 to its original diameter, and unfolding the bag 10.

The diameter of the channel 28 and the total area defined by it may vary from embodiment to embodiment, and will depend on the size of the bag 10, the type of fabric used, the number of layers of fabric material, the nature and size of any hardware fittings that may be present on the bag 10 (such as grommets 24 and clips 26), and other factors. As those of skill in the art will appreciate, the diameter of the channel 28 should be large enough so that the rest of the bag 10 can be successfully compressed into it when the drawstring is pulled.

Typically, the diameter of the channel 28 is in some defined proportion to a dimension of one of the sidewalls 12, 14 of the bag. In one embodiment, for example, the channel 28 may have a diameter, shown as D in FIG. 2, of approximately 10 inches in a bag 10 with a bottom width W of approximately 14 inches. In general, the area enclosed by the channel 28 may range from about 23% to about 35% (alternatively, about one-fourth to about one-third) of the surface area of the panel on which the channel 28 is placed.

In at least some embodiments, the fabric used for the bag 10 is preferably of a type conducive to the kind of compression shown in FIGS. 4-7, and more preferably, does not wrinkle significantly after being compressed and then released. Satin-type fabrics have been found to be particularly advantageous. One specific example of the fabrics that may be used is given below in Table 1.

TABLE 1

Fabrics.

| | Outer Sidewall Layer | Inner Sidewall Layer |
|---|---|---|
| Material | Satin | Satin |
| Composition | Polyester | 190T Polyester |
| Density | 254/76 | 111/82 |
| Yarn | 75D × 300D | 75D × 75D |

If the bag 10 is not made entirely of the materials above, or other similar, low friction, non-wrinkling materials, the bag 10 may be selectively or fully lined with those materials, at least in the area that will serve as the sidewalls of the bag 10 in the compressed configuration shown in FIG. 6. If low friction materials are used in portions of the bag 10 that will become its interior sidewall in the compressed configuration, then it may be easier to release the bag 10 from its compressed configuration, particularly if the materials of which the majority of the bag 10 is made are not low friction or particularly smooth. For example, a bag 10 with sidewall panels primarily made of canvas could be lined with one of the satin materials provided above, so that the interior sidewall of the bag 10 in its compressed configuration is low friction. Any linings that are provided for this purpose may be hidden from exterior view.

Generally speaking, reducing friction in the bag 10 and between its various components is helpful, as that may allow the bag 10 to expand more readily from the compressed state and to return more easily to its usable, uncompressed state. If it is not possible or desirable to make the bag 10 from low-friction materials, or to line the bag 10 with such materials, making the drawstring 32 from such materials may be advantageous. For example, instead of using braided nylon cord with a round cross-section as the drawstring 32, the drawstring 32 could be made from a flat satin ribbon. In that case, the width of the channel 28 may also be increased, for example, so that the channel 28 is between about three-quarters to about seven-eighths of an inch wide. The flat satin ribbon that serves as a drawstring may itself be from about one-half inch to about three-quarters of an inch wide.

Figure 3:
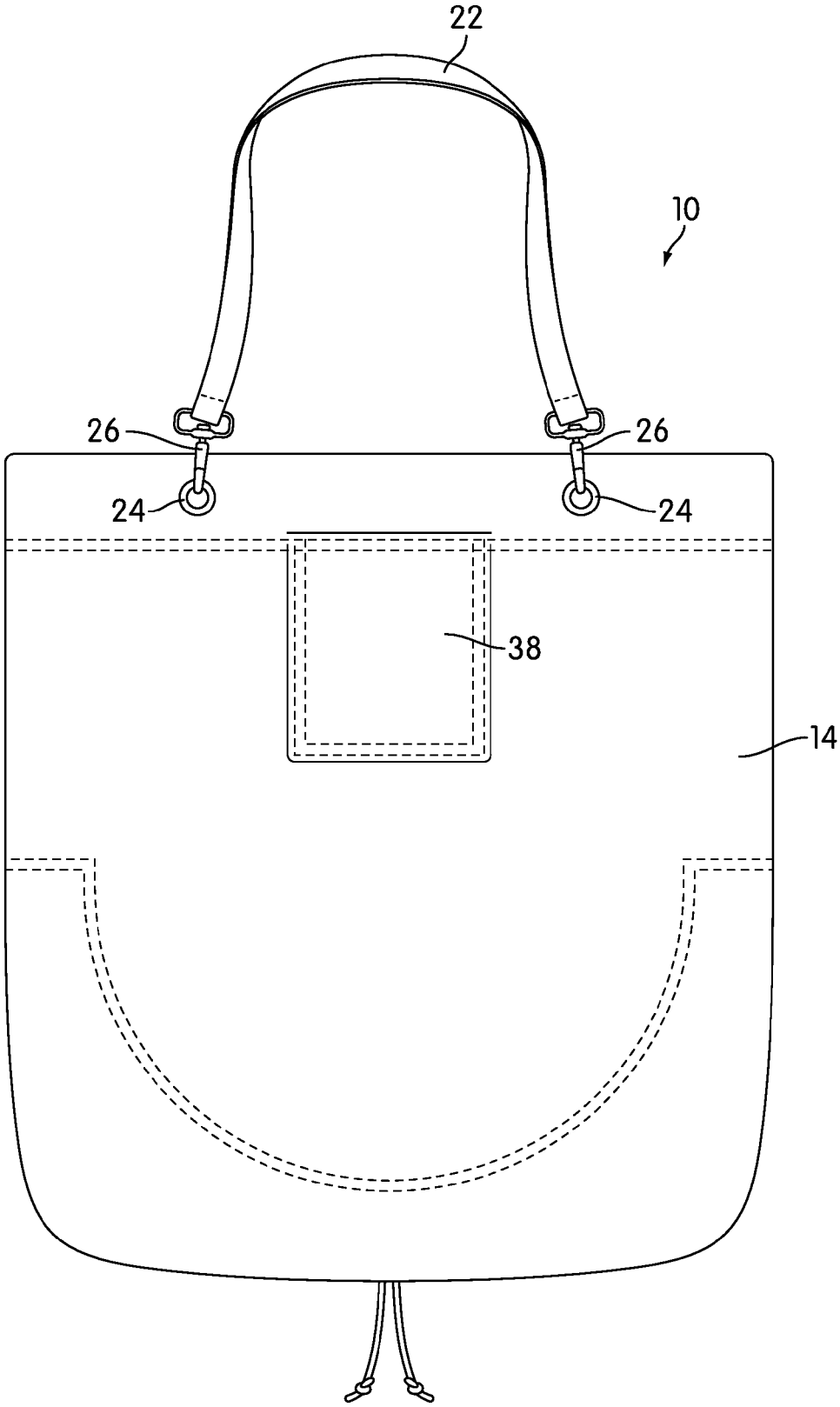
FIG. 3 is a back view of the bag of FIG. 1.

In addition to the features described above, the bag 10 may have any other conventional features. For example, as shown in FIG. 3, a rear view of the bag 10, the bag includes a sewn exterior pocket 38. Additionally, the ends of the drawstring may be knotted together or otherwise made contiguous so as to form a loop, so that the bag 10 may be hung easily in its compressed state.

Thus, in the embodiment of FIGS. 1-6, a generally circular channel 28 and drawstring 32 are provided in a sidewall panel of the bag 10, positioned so that they are not proximate to the main opening of the bag 10. Using the drawstring 32, the fabric area 30 defined and enclosed by the channel 28 can be drawn up around the rest of the bag 10 to encapsulate and compress the bag 10.

In some embodiments, both sidewalls 12, 14 could include a channel 28 and a drawstring 32, and the user could use whichever one is desired to compress the bag. Moreover, the channel 28 need not be perfectly circular; rather, in some embodiments, it may be slightly eccentric or oval-shaped, and the phrase "generally circular" should be construed to cover those embodiments.

Figure 7:
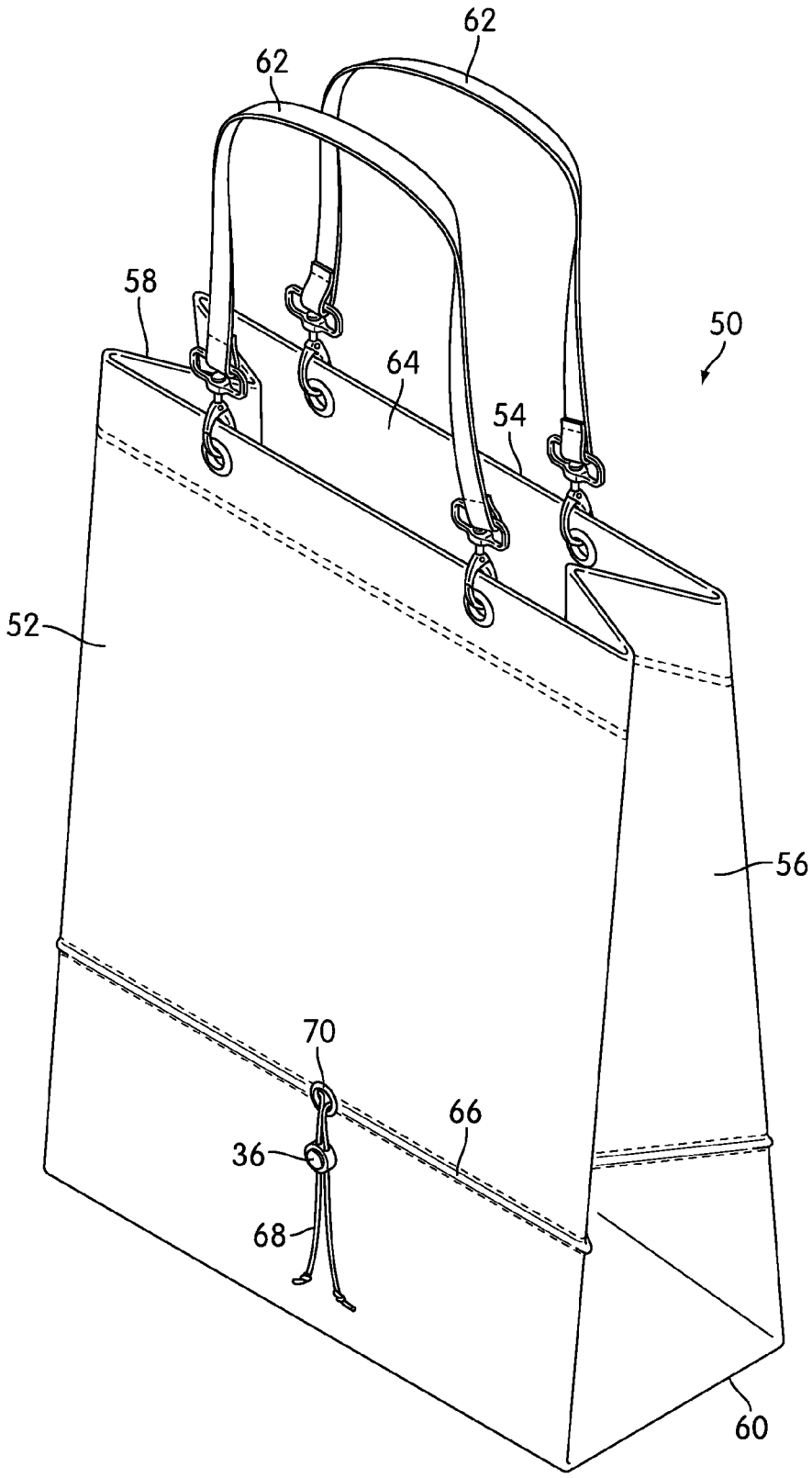
FIG. 7 is a perspective view of a bag according to another embodiment of the invention.
Figure 8:
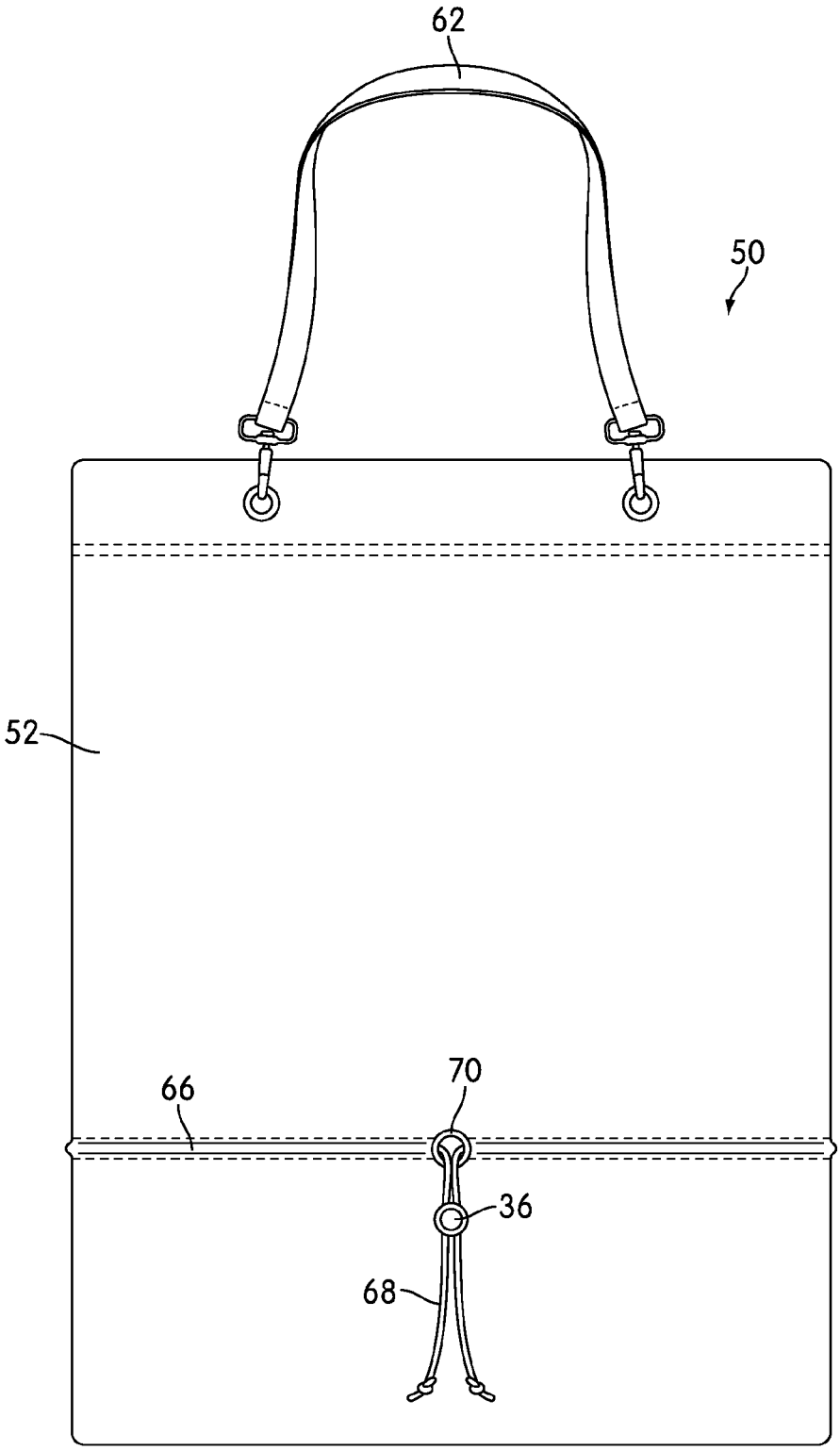
FIG. 8 is a front view of the bag of FIG. 7.

In other embodiments, a drawstring may extend around more than one panel of the bag. FIG. 7 is a perspective view of another embodiment of a bag, generally indicated at 50, and FIG. 8 is a front view of the bag 50. The bag 50 includes first and second sidewalls 52, 54 that are joined together by left and right folding sidewalls 56, 58 that increase the overall volume of the bag 50. The bag 50 also includes a rectangular bottom 60 that joins all four sidewalls 52, 54, 56, 58 at their bottom edges, and handles 62 that attach to the bag 50 proximate to its opening 64. Although FIGS. 7 and 8 illustrate the bag 50 with handles 62 and attachment hardware similar to those of the bag 10 of the previous embodiment, essentially any type of handles and any type of attachment may be used.

A bag like the bag 50 of FIGS. 7-8 may have a generally circular channel with a drawstring on one sidewall, like the bag 10 of the previous embodiment. However, as shown in FIGS. 7-8, the bag 50 includes a channel 66 that extends essentially circumferentially around all four sidewalls 52, 54, 56, 58 of the bag 50. The channel 66 may be formed in essentially the same ways as the channel 28—either by joining two layers of sidewall material, or by securing additional fabric externally or internally to the sidewall. Like the channel 28, the channel 66 of the bag 50 carries a flexible elongate member or drawstring 68 that extends around substantially the entirety of the channel 66 and protrudes from an opening 70 in the channel 66. A cinching device 36 is carried on the drawstring 68.

Figure 9:
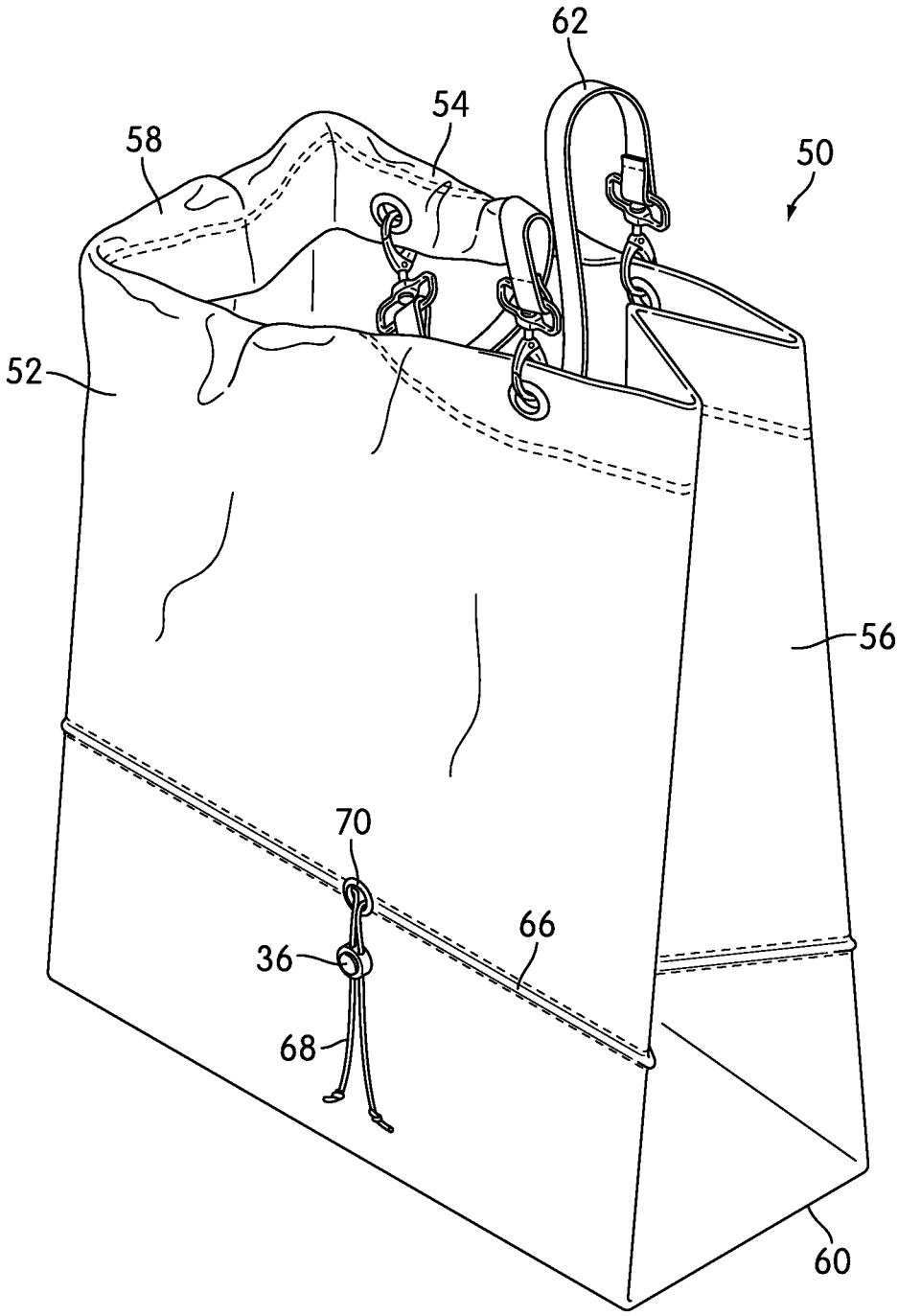
FIGS. 9-11 are perspective views illustrating the process of collapsing the bag of FIG. 7.
Figure 10:
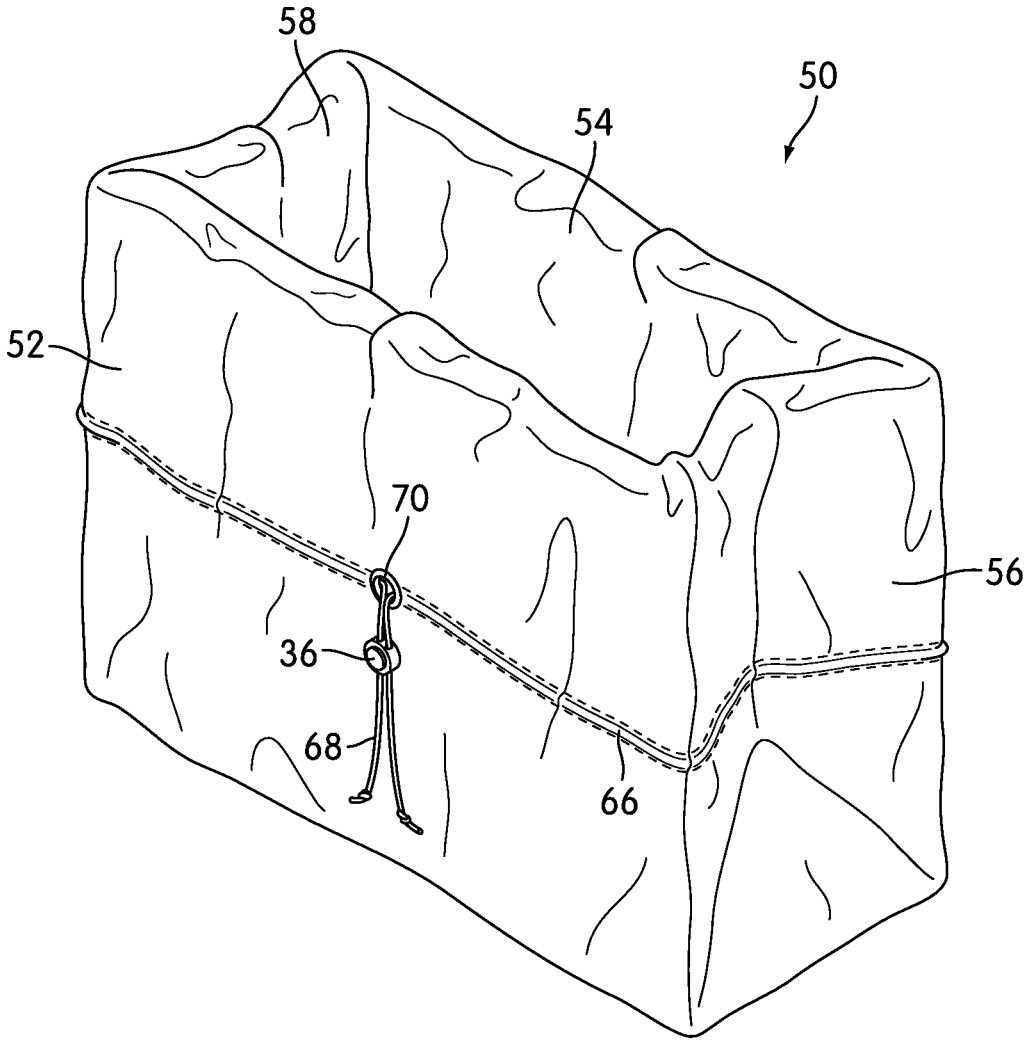
Figure 11:
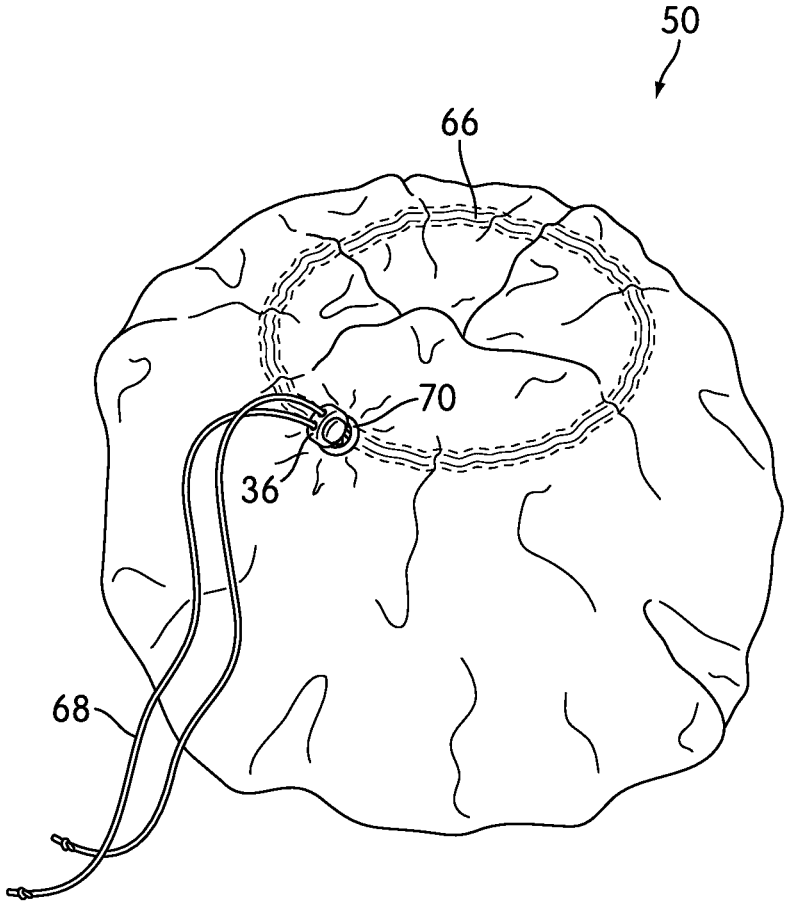

Like the bag 10, the bag 50 can be compressed. The process of compressing the bag 50 is shown in the perspective views of FIG. 9-11. As shown in those figures, the bag 50 is folded or collapsed down into the volume of space defined by the bag 50 between the bottom 60 and the position of the channel 66. Once the bag is within that volume of space, the user pulls the drawstring 68 to contract the channel 66 and compress the bag 50. Following that, the user would slide the cinching device 36 upwardly along the drawstring 68 until it bears against the opening 70 to retain the bag 50 in the compressed position, as shown in FIG. 11. The bag 50 can be uncompressed by reversing the sequence shown in FIGS. 9-11.

Although the bag 50 is shown as having four sidewalls and a rectangular bottom, a generally circumferentially-extending channel and drawstring could be used in a bag of any configuration, including the bag 10 of FIGS. 1-6.

In the embodiments described above, bags are provided with channels and drawstrings allowing them to be compressed. However, embodiments of the present invention need not be limited to bags; rather, a drawstring and channel may be added to any panel of flexible material to allow that material to be compressed within itself.

Figure 12:
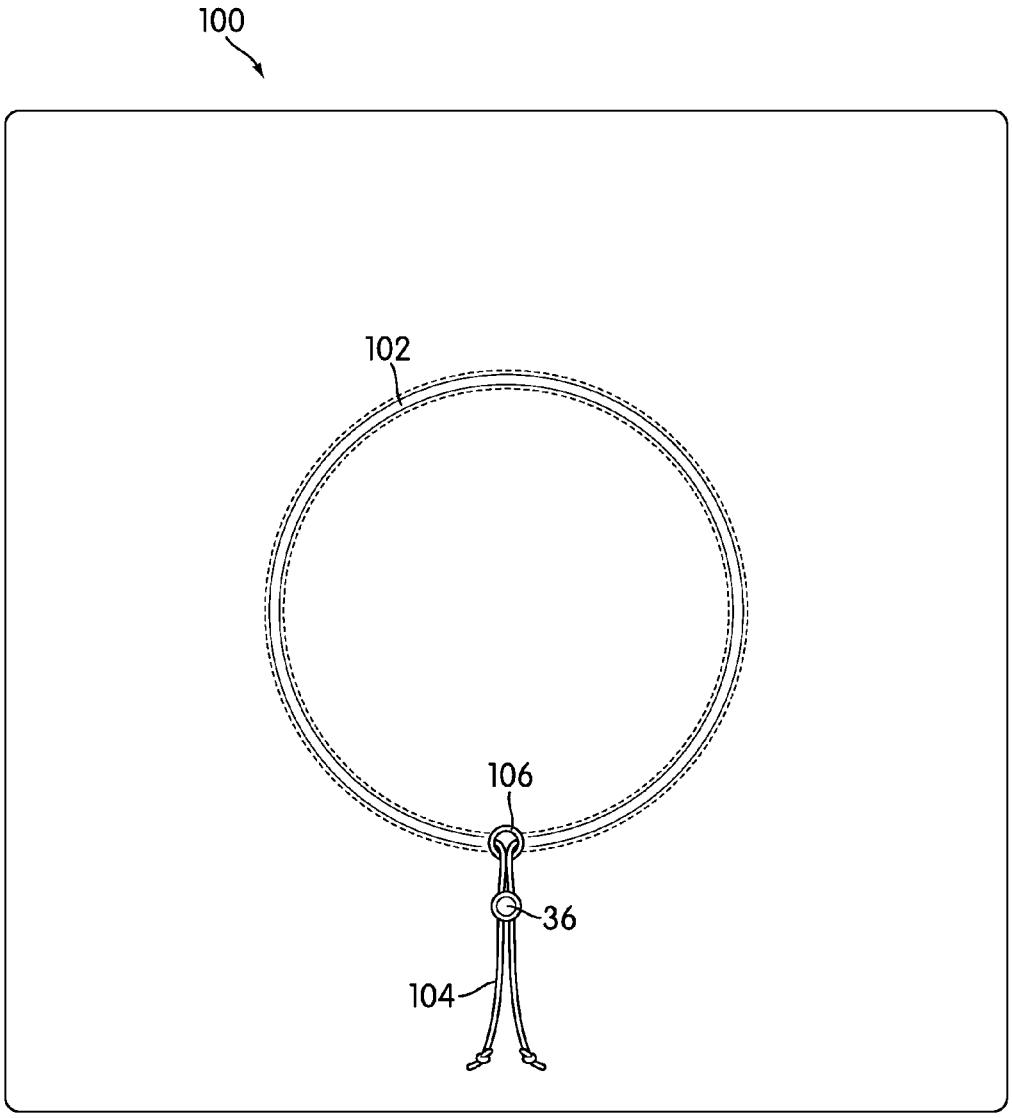
FIG. 12 is a front view of a panel of a collapsible blanket or towel according to another embodiment of the present invention.

For example, FIG. 12 is a front elevational view of a panel of material, generally indicated at 100. The panel of material 100 may, for example, be a blanket or throw, such as a fleece blanket, or it may be a towel. Alternatively, the panel of material 100 may be one panel of a larger item. The panel of material 100 includes a generally circular channel 102. A flexible, elongate member or drawstring 104 extends around substantially the entirety of the circumference of the channel and protrudes from an exterior opening 106 in the channel 102. The ends of the drawstring 104 pass through a cinching device 36.

With the arrangement of FIG. 12, the material 100 may be compressed in essentially the same way as the bag 10 of FIGS. 1-6: with the side of the material 100 having the channel 102 facing outwardly, the material 100 is folded inwardly, toward the area defined by the channel 102. When the drawstring 104 is pulled, the channel 102 contracts and the area defined by it is drawn up to encapsulate the rest of the material 100.

With a single panel or ply of material, like the material 100 of FIG. 12, the proportion of the channel 102 relative to the material 100 may be different than the proportions of the channel 28 in the bag 10, which includes two thicknesses of material plus associated hardware. The diameter of the channel 102 will generally depend on the type and thickness of the material 100. For example, if the material is 60 inches by 60 inches, the diameter of the channel may be on the order of 20 inches. Moreover, although a square sheet of material 100 is shown in FIG. 12, the material 100 need not be square or rectangular. Instead, round blankets, towels, and other items may be made according to embodiments of the invention.

In the description above, compressible and storable bags and blankets were shown. However, many items that are made of flexible material may be made compressible and storable in essentially the same ways as illustrated above. Examples of other items that may be made compressible in the same way as the bag 10 and material 100 include apparel (sweatshirts, jackets, baby items, etc.), sheets, and towels.

Figure 13:
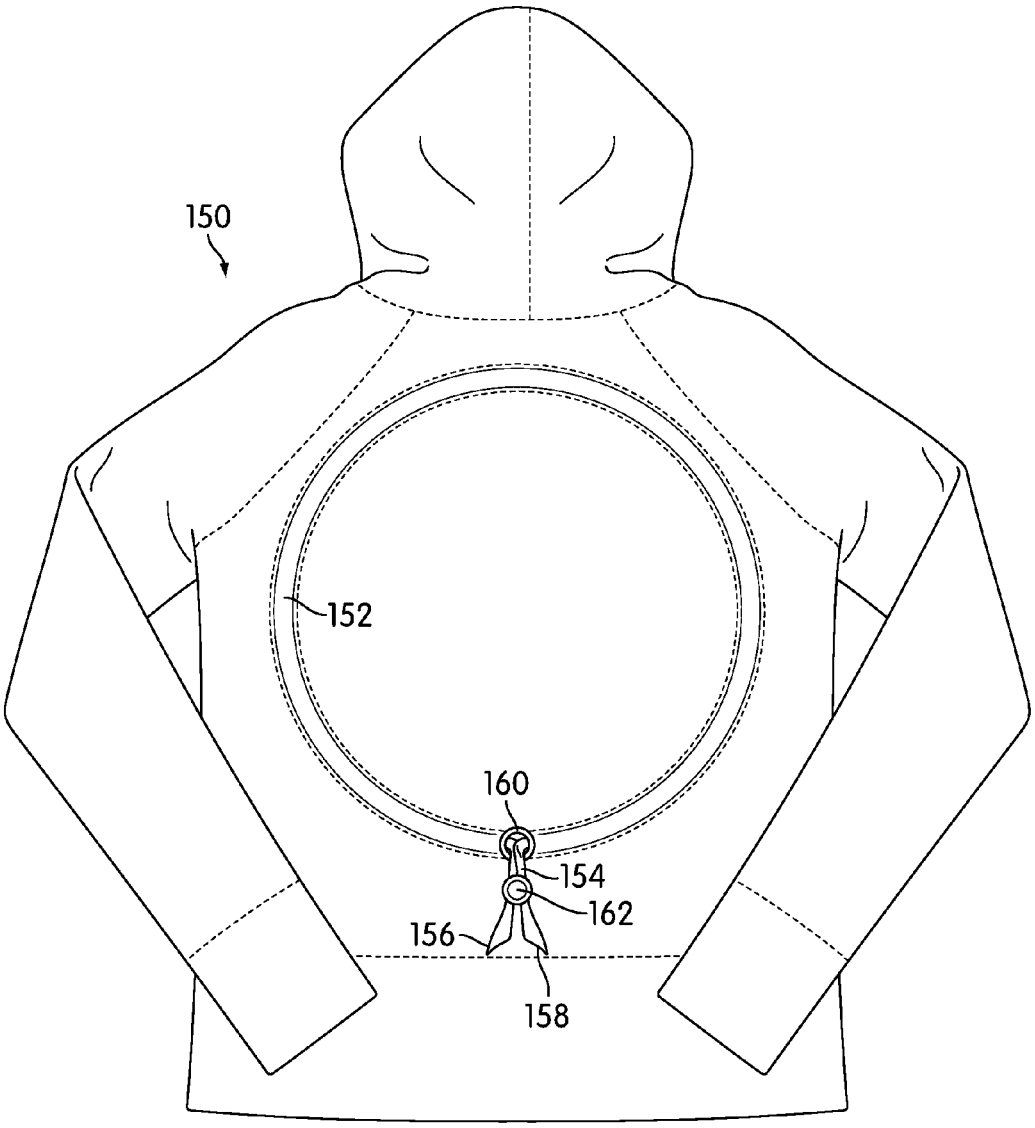
FIG. 13 is a rear view of a hooded sweatshirt according to another embodiment of the invention.

As one example of an apparel item that may be made compressible and storable according to the principles of the present invention, FIG. 13 is a rear view of a hooded, long-sleeved sweatshirt, generally indicated at 150. The hooded sweatshirt 150 may be made, for example, from such materials as cotton and fleece, and has a generally circular channel 152 sewn into the torso portion of its back panel. Positioned within the channel 152 is a drawstring 154.

However, as can be seen in FIG. 13, the channel 152 and drawstring 154 are different from the channel 28 and drawstring 32 of the bag 10 described above. Specifically, because the sweatshirt 150 is not made of low-friction materials, and because a hard, round drawstring 32 might cause some wearer discomfort, the drawstring 154 of the sweatshirt 150 is a wide, flat ribbon, preferably made of satin or another low-friction material, as described above. The channel 152 is also wider. The two ends 156, 158 of the drawstring 154 that protrude from the opening 160 in the channel 152 are held using a standard cinching device 162. The opening 160 may be grommeted or, alternatively, reinforced with fabric and/or stitching. The sweatshirt 150 may be compressed in essentially the same way as the bag 10, following the steps shown in FIGS. 4-6.

The arrangement of FIG. 13 may be used with any garment having sufficient size to accommodate a channel appropriate for the garment. These garments need not be limited merely to upper-body garments. Rather, sundresses, beach wear and one-piece garments may also include channels and may thus be made compressible in some embodiments of the invention.

While the invention has been described with respect to certain embodiments, the embodiments are intended to be exemplary, rather than limiting. Modifications and changes may be made within the scope of the invention, which is defined by the claims.

What is claimed is:

1. A compressible and storable item of apparel, comprising:

at least one sheet of flexible material defining the item of apparel;

a generally circular channel in the sheet of flexible material, the generally circular channel defining an area substantially centered on a panel of the item of apparel and having an exterior channel opening, the generally circular channel having a size in defined proportion to one or more dimensions of the item of apparel; and a flexible, elongate member positioned within the generally circular channel and extending through substantially the entirety of the circumference of the channel such that at least an exposed portion of the elongate member protrudes from the opening of the channel;

wherein the generally circular channel is proportioned and arranged such that if the item of apparel is folded inwardly toward the area defined by the generally circular channel with the generally circular channel facing outwardly and the exposed portion of the flexible, elongate member is pulled, the area defined by the generally circular channel is drawn out of plane as the generally circular channel contracts, causing the item of apparel to be releasably compressed within an enclosure having the area defined by the generally circular channel as an outer surface.

2. The compressible and storable item of apparel of claim 1, wherein the flexible elongate member comprises a flat satin ribbon.

3. The compressible and storable item of apparel of claim 2, wherein the flat satin ribbon is from about one-half inch to about two-thirds of an inch wide.

4. The compressible and storable item of apparel of claim 3, wherein the generally circular channel is from about three-quarters of an inch to about seven-eighths of an inch wide.

5. The compressible and storable item of apparel of claim 1, wherein the generally circular channel encloses an area of about 23% to about 35% of an area of the at least one sheet of flexible material.

6. A garment, comprising:

one or more pieces of fabric joined together to define a covering for an upper portion of a human body, the covering having a torso portion, two arm portions connected to the torso portion, and a head opening;

a generally circular channel in a rear panel of the torso portion, the generally circular channel defining an area on the torso portion and having an exterior channel opening, the generally circular channel having a size in defined proportion to the dimensions of the garment; and a flexible, elongate member positioned within the generally circular channel and extending through substantially the entirety of the circumference of the channel such that at least an exposed portion of the elongate member protrudes from the opening of the channel;

wherein the generally circular channel is proportioned and arranged such that if the garment is folded inwardly toward the area defined by the generally circular channel with the generally circular channel facing outwardly and the exposed portion of the flexible, elongate member is pulled, the area defined by the generally circular channel is drawn out of plane as the generally circular channel contracts, causing the garment to be releasably compressed within an enclosure having the area defined by the generally circular channel as an outer surface.

7. The garment of claim 6, wherein the flexible, elongate member comprises a flat satin ribbon.

8. The garment of claim 6, wherein the generally circular channel encloses an area of about 23% to about 35% of an area of the garment.

9. The garment of claim 6, wherein the garment comprises a sweatshirt or a jacket.

10. The garment of claim 9, wherein the garment comprises a hooded sweatshirt.

11. The compressible and storable item of apparel of claim 1, wherein the item of apparel comprises a sweatshirt or a jacket.

* * * * *